US006427390B1

(12) United States Patent
Thies

(10) Patent No.: US 6,427,390 B1
(45) Date of Patent: Aug. 6, 2002

(54) FOUNDATION FLASHING FOR USE IN BUILDING CONSTRUCTION

(76) Inventor: F. Boyce Thies, P.O. Box 6126, Myers Park Station, Charlotte, NC (US) 28207

( * ) Notice: Subject to any disclaimer, the term of this patent is extended or adjusted under 35 U.S.C. 154(b) by 2 days.

(21) Appl. No.: 09/691,361

(22) Filed: Oct. 18, 2000

(51) Int. Cl.[7] ..... E04B 1/00
(52) U.S. Cl. ..... 52/58; 52/302.3
(58) Field of Search ..... 52/58, 62, 96, 52/306, 302.3

(56) References Cited

U.S. PATENT DOCUMENTS

| | | | | |
|---|---|---|---|---|
| 2,144,700 A | | 1/1939 | Barnett | |
| 2,150,891 A | | 3/1939 | Tennison | |
| 2,315,989 A | | 4/1943 | Tennison et al. | |
| 2,674,765 A | | 4/1954 | Tennison | |
| 3,124,427 A | | 3/1964 | Chomes | |
| 3,262,236 A | | 7/1966 | Poyer | |
| 3,299,587 A | | 1/1967 | Puto, Jr. | |
| 3,415,020 A | | 12/1968 | Windle | |
| 4,967,519 A | | 11/1990 | Sieber | |
| 5,097,641 A | | 3/1992 | Hand et al. | |
| 5,239,791 A | | 8/1993 | Mills, Jr. et al. | |
| 5,289,662 A | * | 3/1994 | Castel | 52/287.1 |
| 5,630,297 A | | 5/1997 | Rutherford | |
| 5,836,135 A | * | 11/1998 | Hagan | 52/730.1 |
| 5,904,007 A | * | 5/1999 | Trapnell | 52/101 |
| 6,108,991 A | * | 8/2000 | Hagan | 52/302.3 |
| 6,134,847 A | * | 10/2000 | Bifano | 52/58 |
| 6,293,064 B1 | * | 9/2001 | Larson | 52/302.1 |
| 6,298,609 B1 | * | 10/2001 | Bifano | 52/58 |

* cited by examiner

*Primary Examiner*—Beth A. Stephan
(74) *Attorney, Agent, or Firm*—Alston & Bird LLP

(57) ABSTRACT

A foundation flashing comprises a horizontal member adapted to rest atop the upper surface of a foundation between the upper surface and a frame of the building supported atop the foundation, and a vertical member joined to the horizontal member. At least a portion of the vertical member is adapted to lie against a surface of exterior sheathing that is affixed to the frame of the building. A sheathing locator projects generally horizontally from the vertical member, the sheathing locator being positioned to be abutted by a bottom edge of the sheathing when the sheathing is affixed to the frame. The flashing in one embodiment is disposed between the sheathing and the frame of the building, the sheathing locator projecting outwardly from an outer surface of the flashing. In another embodiment, the flashing is disposed against an outer surface of sheathing affixed to the frame, the sheathing locator projecting inwardly from an inner surface of the flashing and serving to space the vertical member of the flashing away from the building frame so that the sheathing can be installed between the frame and the vertical member of the flashing. Where the flashing is to be disposed against an outer surface of sheathing, the vertical member of the flashing includes a nail stop guide provided on its outer surface as a warning to a worker not to nail through the flashing below the nail-stop guide.

10 Claims, 2 Drawing Sheets

FOUNDATION FLASHING FOR USE IN BUILDING CONSTRUCTION

FIELD OF THE INVENTION

The invention relates to foundation flashings used in building construction for providing protection against intrusion of water between the foundation and the structure built thereon. The invention also relates to insect shields used in building construction for deterring insects such as termites from crawling along the inner surface of the foundation into the structure.

BACKGROUND OF THE INVENTION

In the construction industry, it is mandatory in some localities for builders to attach a piece of flashing to the exterior sheathing along the upper surface of the foundation. Conventional flashing is constructed of an "L" shaped plastic or metal member. The flashing provides a water seal between the ambient environment and the joist band and sill plate supported atop the upper surface of the foundation.

When attaching the exterior sheathing, it is customary to raise the sheathing above the upper surface of the foundation to prevent wicking of water from the foundation to the sheathing. The space created between the foundation and the exterior sheathing allows moisture to evaporate and thereby prevents water damage to and deterioration of the sheathing. This space is not always provided, however, because the person hanging the sheathing may lack experience, be unaware of the importance of spacing the sheathing above the foundation, or may possibly even be indifferent as to how the sheathing is installed.

U.S. Pat. No. 2,144,700 issued to Barnett discloses a foundation sheathing that has a horizontal portion having notches cut into an inner edge thereof to form anchor members 2. The opposite edge of the horizontal portion is bent at a right angle to form a vertical portion, and by molding the sheathing into the foundation at the time it is poured, a channel is formed between this vertical portion and an outer surface of the foundation wall for receiving the exterior sheathing 11. The patent notes the problems associated with conventional methods for attaching sheathing using nails, namely, that the nails rust over time loosening the sheathing from the foundation and resulting in the sheathing curling along the bottom edge, which can crack the bottom edge of the plaster on the exterior of the building and thus expose the interior wooden support structure to termites and other wood-destroying insects. Accordingly, as taught by the Barnett '700 patent, the anchor members 2 of the foundation flashing are permanently secured within the cementitious foundation in order to eliminate the use of nails as a means of securing the sheathing to the foundation. Further, the flashing of Barnett is said to form a metal barrier that obstructs the path of crawling termites.

Other types of termite shields are utilized in the building industry to prevent termites and other wood-destroying insects from gaining access to the joist band, sill plate, or other wooden frame members by climbing the inner surface of foundation walls. Conventional termite shields are secured between the sill plate and the upper surface of the foundation and extend inwardly beyond the inner surface of the foundation at a downward angle. Termites climbing up the inner surface of the foundation wall tend to be deterred from reaching the sill plate and joist band and other wooden frame members by the inwardly and downwardly extending termite shield.

U.S. Pat. No. 2,150,891 issued to Tennison discloses a termite shield having a horizontal portion 31 positioned between the sill plate and the foundation and two bent baffle portions 32 that extend outward and inward from the outer and inner edges of the horizontal portion and slope downwardly at an angle of 45°.

U.S. Pat. No. 5,097,641 issued to Hand discloses a termite shield formed of a vertical support member 20A and a horizontal support member 22A. An obstacle wall 39 projects downwardly at an angle from the top of the vertical support member 20A, while a plate member 18 projects horizontally from the bottom of the vertical support member 20A to thereby form a barrier area.

SUMMARY OF THE INVENTION

The invention pertains to an improved foundation flashing having, in some embodiments, an integral termite shield. In other embodiments, the improved flashing includes a sheathing locator providing a reference for locating a bottom edge of sheathing in a desired location relative to a foundation. In still other embodiments, the flashing includes a nail stop guide providing a warning to a worker not to nail through the flashing and sheathing below the nail stop guide, which is positioned proximate a bottom edge of the sheathing.

In accordance with a first preferred embodiment of the invention, a foundation flashing comprises a horizontal member adapted to rest atop the upper surface of a foundation between the upper surface and a frame of the building supported atop the foundation, and a vertical member joined to the horizontal member. At least a portion of the vertical member is adapted to lie against a surface of sheathing that is affixed to the frame of the building. The flashing further includes at least one sheathing locator projecting generally horizontally from said portion of the vertical member, the sheathing locator being positioned to be abutted by a bottom edge of the sheathing when the sheathing is affixed to the frame. Thus, the sheathing locator provides a reference for locating the sheathing relative to the foundation. The flashing can be formed either to be disposed between the sheathing and the frame of the building, in which case the sheathing locator projects outwardly from an outer surface of the flashing, or to be disposed against an outer surface of sheathing affixed to the frame, in which case the sheathing locator projects inwardly from an inner surface of the flashing. The sheathing locator preferably provides a reference for hanging the exterior sheathing at a proper height above the upper surface of the foundation. The sheathing locator thus facilitates preventing deterioration of the sheathing by preventing wicking of water from the foundation to the sheathing and by providing adequate spacing for evaporation of any moisture that may be absorbed by the sheathing.

In one embodiment suitable for use in conjunction with brick veneer or other masonry siding, the horizontal member extends outward beyond the outer edge of the foundation and is anchored within the brick veneer. In another embodiment of the invention suitable for use in a building having vertical foundation walls that bound a crawl space or basement, a portion of the horizontal member projects inwardly beyond the inner surface of the foundation wall and includes an integral termite shield that slopes inwardly at a downward angle. The termite shield tends to prevent termites and other wood-destroying insects from accessing the sill plate, joist band, and other wooden frame members.

Preferably, where the flashing is to be disposed against an outer surface of sheathing, the vertical member of the flashing includes a nail stop guide, such as a horizontal line or flange, provided on the outer surface of the vertical member. The nail stop guide provides a warning to a worker not to nail through the flashing and sheathing below the nail-stop guide. This embodiment may also include an integral termite shield.

In another embodiment of the invention for use with wood siding and stucco, the vertical member of the flashing extends downwardly beyond the horizontal member a predetermined distance that depends upon how low the wood siding or stucco is to be applied relative to the foundation. A sheathing locator may be provided on the vertical member for properly positioning the sheathing. The flashing may also include an integral termite shield.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figures 1, 2:
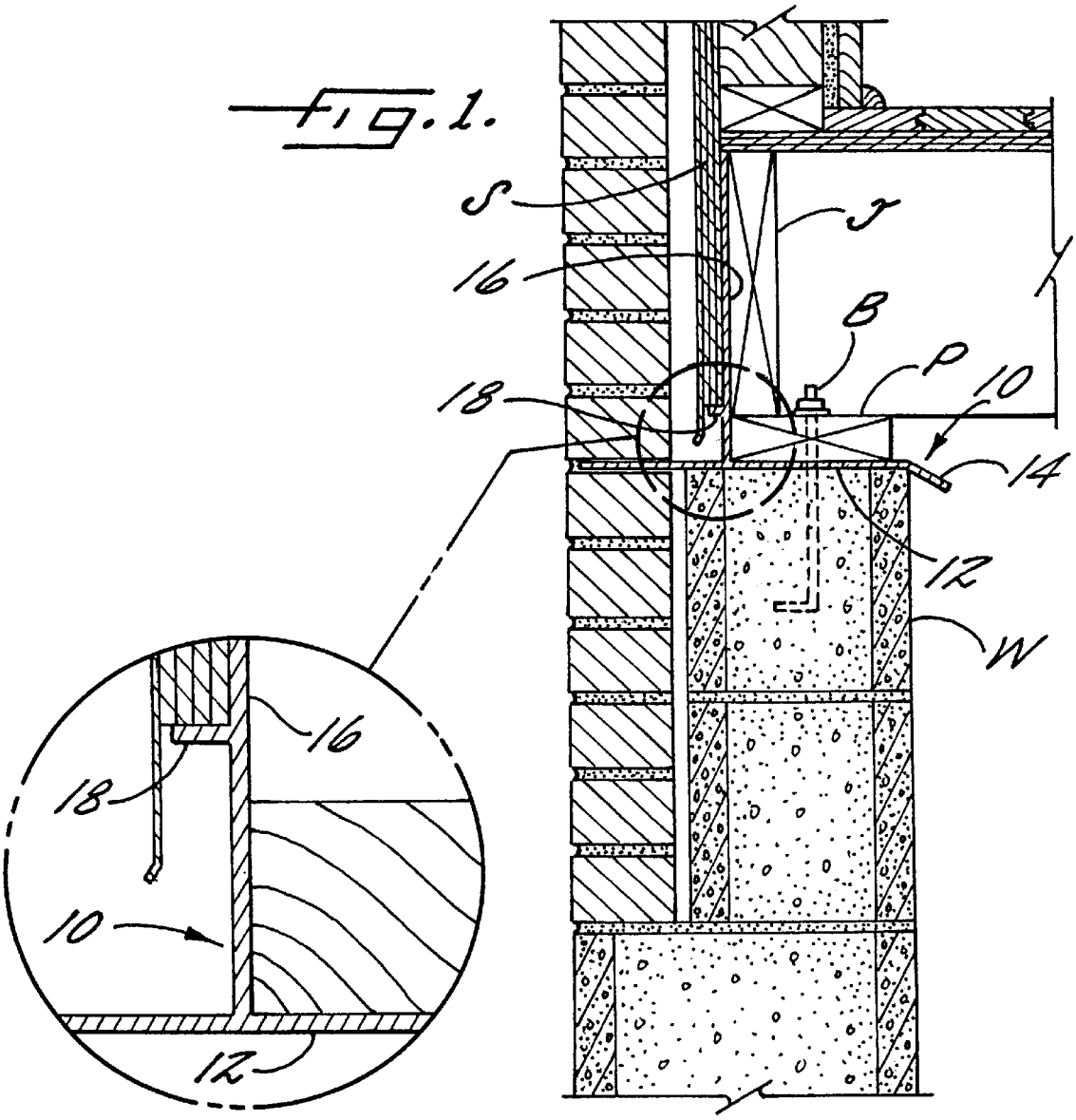
FIG. 1 is a cross-sectional view showing a foundation flashing in accordance with a first preferred embodiment of the invention installed between a joist band and exterior sheathing, with a portion of the flashing being anchored in brick veneer applied to the building.
FIG. 2 is an enlarged view of a portion of FIG. 1, showing a sheathing locator of the flashing in greater detail.

With reference to FIGS. 1 and 2, a foundation flashing in accordance with a first preferred embodiment of the invention is broadly designated by reference numeral 10. The flashing 10 includes a horizontal member 12 that is adapted to be disposed between an upper surface of a foundation wall W and a sill plate P attached to the foundation wall by anchor bolts B or the like. The horizontal member 12 comprises a plate-shaped or sheet-like member, and can be formed of metal such as sheet metal, plastic, or other suitable material. The material is preferably impervious to moisture. The horizontal member 12 includes a portion 14 that extends inwardly beyond the inner surface of the foundation wall W. The portion 14 advantageously slopes downwardly away from the foundation wall at an angle so as to form a termite shield tending to deter termites and other crawling insects from crawling from the inner surface of the foundation wall W to the sill plate P and other wooden frame members of the structure. The termite shield 14 may slope downwardly at an angle of, for example, about 30° to 60° relative to horizontal, although the invention is not limited to any particular angle.

The flashing 10 also includes a vertical member 16 adapted to be disposed between a joist band J of the building frame and an exterior sheathing S that is affixed to the outer surface of the frame. The vertical member 16 comprises a plate-shaped or sheet-like member formed of a suitable moisture-impervious material such as metal or plastic. The vertical member 16 is joined to the horizontal member 12 to form a unitary structure. A sheathing locator 18 is formed on the vertical member 16 and projects outwardly from the outer surface thereof. The sheathing locator 18 comprises a flange or ledge adapted to be abutted by a bottom edge of the sheathing S, as best seen in FIG. 2. Accordingly, the sheathing locator 18 provides a reference for locating the bottom edge of the sheathing S relative to the foundation wall W. More particularly, and in a preferred embodiment of the invention, the sheathing locator 18 is spaced vertically higher than the horizontal member 12 such that the bottom edge of the sheathing S will be spaced higher than the upper surface of the foundation wall W. In this way, there will be adequate space between the foundation and the sheathing so that the tendency of the sheathing to wick moisture up from the foundation will be substantially reduced or eliminated. The sheathing locator 18 preferably is integrally formed with the vertical member 16, although alternatively it may be formed separately and then affixed to the vertical member. In one embodiment, a single sheathing locator 18 extends lengthwise along the flashing 10. Alternatively, a plurality of separately formed sheathing locators can be provided spaced along the length of the flashing.

In the embodiment of the invention shown in FIGS. 1 and 2, the horizontal member 12 of the flashing also includes an outer portion 20 that extends outwardly beyond the outer surface of the foundation wall W. The outer portion 20 is adapted to be anchored within a brick veneer V or similar masonry siding applied to the outer surface of the building.

The flashing 10 can be formed in various ways. For example, the flashing can be formed from sheet metal stock that is bent to form the various features of the flashing. Alternatively, where the flashing is formed of plastic, the flashing can be extruded or formed by any other suitable technique known in the art. The invention is not limited to any particular forming method.

Figure 3:
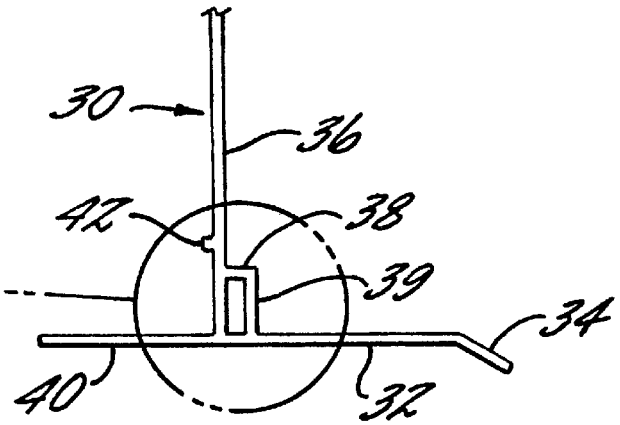
FIG. 3 is a cross-sectional view of a foundation flashing in accordance with a second preferred embodiment of the invention adapted to be disposed against an outer surface of exterior sheathing of a building, and having a sheathing locator for spacing the sheathing above the upper surface of a foundation.
Figure 4:
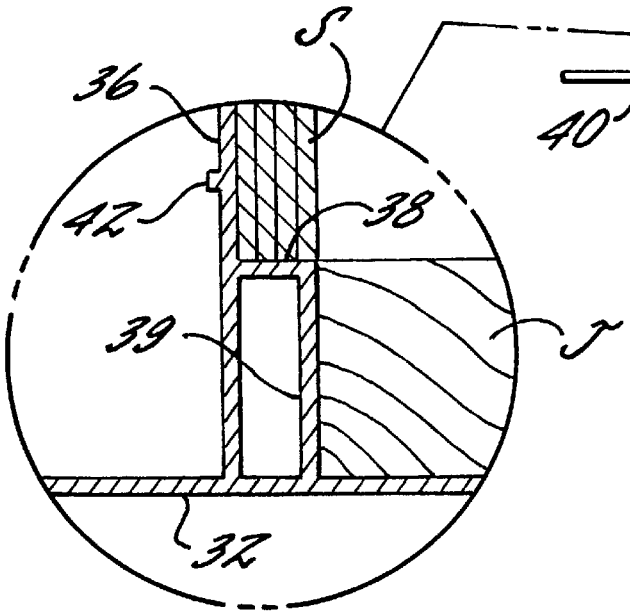
FIG. 4 is a fragmentary cross-sectional view similar to FIG. 2, but showing the flashing of FIG. 3.

FIGS. 3 and 4 depict an alternative embodiment of the invention suitable for a building having brick veneer or similar masonry siding. The flashing 30 is similar in many respects to the flashing 10 previously described, except that it is adapted to be disposed against an outer surface of exterior sheathing S. The flashing 30 includes a horizontal member 32 substantially identical to the horizontal member 12 of the flashing 10, including an integral termite shield 34 and an outer portion 40 having the same construction and purposes as the corresponding features of the flashing 10. The flashing 30 differs from the flashing 10 in the region of the vertical portion 36. The vertical portion 36 includes a sheathing locator or spacer 38 formed on the inner surface that faces the frame of the building. The spacer 38 is formed generally as a flange or ledge that extends lengthwise along the flashing a predetermined distance above and parallel to the horizontal member 32. The spacer 38 is adapted to be abutted by the bottom edge of sheathing S affixed to the frame of the building, as shown in FIG. 4. Advantageously, the spacer 38 has sufficient strength to support the weight of the sheathing S so that a worker can position a piece of sheathing against the wall frame members and slide the sheathing down into the space defined between the vertical member 36 and the wall frame members such that the sheathing is supported on the spacer 38, and can then nail or otherwise secure the sheathing to the frame. As with the sheathing locator 18 of the previously described flashing 10, the spacer 38 thus serves to ensure that the sheathing is located a uniform distance above the foundation. The spacer 38 preferably includes a vertical portion 39 that extends from the spacer 38 down to the horizontal member 32. The vertical portion 39 serves to space the vertical member 36 of the flashing outward of the joist band J by a sufficient distance to allow sheathing to be slid down into the space between the vertical member 36 of the flashing and the joist band.

When nailing the sheathing S to the wall frame members, the worker will also nail through the flashing 30. However, because the flashing 30 is on the exterior side of the lower portion of the sheathing, the worker cannot see where the bottom edge of the sheathing is located, and thus may not be sure how far down the nails should be placed. There is a possibility that a worker may nail through the flashing too close to the bottom edge of the sheathing or may nail through the flashing so close the horizontal member 32 of the flashing that the water-barrier function of the flashing is compromised. To aid the worker in this regard, the flashing 30 also includes a nail stop guide 42 formed on the outer surface of the vertical member 36 spaced higher than the sheathing spacer 38 and extending lengthwise along the flashing parallel to the spacer 38. The nail stop guide 42 provides a readily visible warning to the worker not to nail below the guide. The nail stop guide 42 can be formed in various ways, the chief consideration being that it should be readily visible. As shown in the drawings, the nail stop guide 42 can comprise a protrusion such as a ridge or bead formed on the outer surface of the vertical member 36. Alternatively, the guide could be formed as an indentation in the outer surface, or could be printed onto the outer surface with ink or the like.

Figure 5:
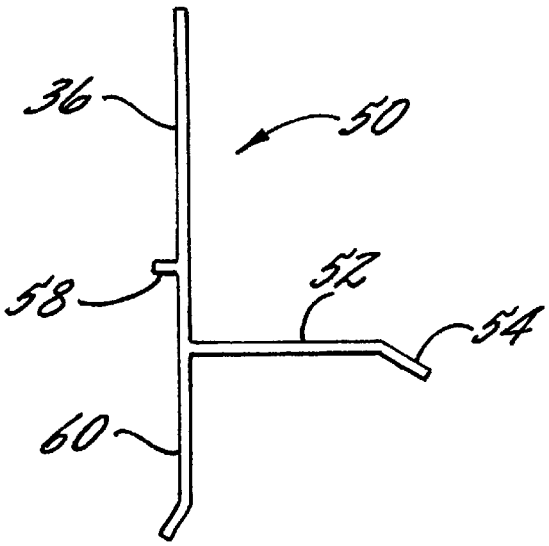
FIG. 5 is a cross-sectional view of a foundation flashing in accordance with a third preferred embodiment of the invention.
Figure 6:
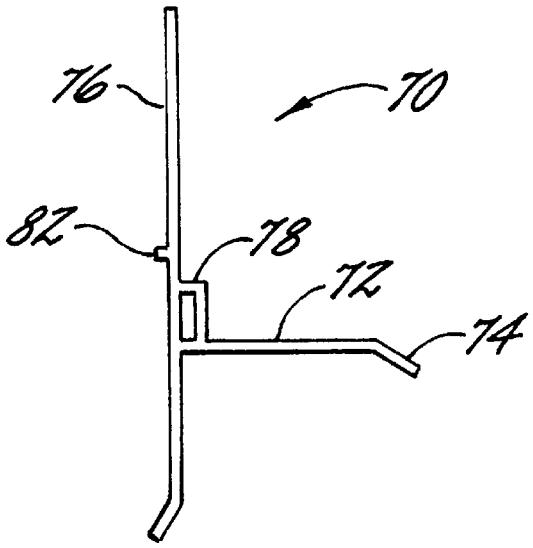
FIG. 6 is a cross-sectional view of a foundation flashing in accordance with a fourth preferred embodiment of the invention.

The invention also provides foundation flashings suitable for use in buildings having wood or stucco siding. FIGS. 5 and 6 depict two alternative embodiments of the invention useful for such applications. FIG. 5 depicts a foundation flashing 50 generally similar to the flashing 10 previously described. The flashing 50 includes a horizontal member 52 whose inner portion defines an integral termite shield 54. A vertical member 56 is adapted to be disposed between an exterior sheathing and the frame of the building, similar to the flashing 10. However, unlike the flashing 10, the horizontal member 52 of the flashing 50 terminates where it joins with the vertical member 56, and the vertical member 56 includes a lower portion 60 forming an extension of the vertical member 56 and extending downward from the outer edge of the horizontal member 52. The lower portion 60 can extend downward below the horizontal member 52 by relatively smaller or larger distances depending primarily on how low the wood siding or stucco is to be applied relative to the foundation. As with the flashing 10, the flashing 50 may include a sheathing locator 58 projecting outwardly from the outer surface of the vertical member 56 for properly locating the bottom edge of the exterior sheathing relative to the foundation. Although the sheathing locator 58 is depicted as being at a higher vertical level than the horizontal member 52, it can instead be at the same level as or lower than the horizontal member 52, for example in the case of stucco or wood siding applications.

FIG. 6 shows yet another embodiment of the invention suitable for wood siding or stucco applications. The flashing 70 is generally similar to the flashing 50, except that it is adapted to be disposed on the exterior side of the exterior sheathing, similar to the flashing 30 of FIG. 3. The flashing 70 includes a horizontal member 72 constructed in the same manner as the horizontal member 52 of the flashing 50, including an integral termite shield 74. The vertical member 76 of the flashing 70 includes a sheathing spacer 78 constructed in the same manner and for the same purpose as the spacer 38 described in connection with the flashing 30 of FIG. 3. The vertical member 76 also includes a nail stop guide 82 constructed in the same manner and for the same purpose as the nail stop guide 42 of the flashing 30.

Many modifications and other embodiments of the invention will come to mind to one skilled in the art to which this invention pertains having the benefit of the teachings presented in the foregoing descriptions and the associated drawings. For example, although all of the illustrated and described embodiments of the invention have included an integral termite shield, it is within the scope of the invention to eliminate the termite shield if it is not needed. For instance, the invention can be used in connection with buildings constructed upon a slab foundation, in which case there is no need for the termite shield since there is no crawl space or basement below the structure. However, the other aspects of the invention, including the sheathing locator, sheathing spacer, and/or nail stop guide can still be useful in such slab constructions. Conversely, in other situations it may be desirable to have the integral termite shield, but the sheathing locator, sheathing spacer, and/or the nail stop guide may not be needed or desired. Thus, various combinations of the unique features of the invention can be made depending on the needs of a particular application. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A foundation flashing for use in construction of a building of the type including a foundation having an upper surface, a frame built upon said upper surface of said foundation, and vertically oriented exterior sheathing attached to outer surfaces of said frame, the foundation flashing comprising:

a horizontal member adapted to rest atop said upper surface of said foundation between said upper surface and said frame;

a vertical member joined to the horizontal member, at least a portion of the vertical member being adapted to lie against a surface of said sheathing, wherein the vertical member includes a lower portion extending downward from the horizontal member, the lower portion being adapted to lie against an outer surface of said foundation; and at least one sheathing locator projecting generally horizontally from said portion of the vertical member, the sheathing locator being positioned to be abutted by a bottom edge of said sheathing when said sheathing is affixed to said frame, whereby the sheathing locator provides a reference for locating said sheathing relative to said foundation.

2. The foundation flashing of claim 1, wherein the sheathing locator comprises a ledge projecting from the vertical member and extending lengthwise along the foundation flashing.

3. A foundation flashing comprising:

a horizontal member having an inner portion for resting atop an upper surface of a building foundation and an outer portion for projecting outwardly away from the foundation;

a vertical member projecting upward from the horizontal member, the vertical member being joined to the horizontal member at a juncture between the inner and outer portions thereof such that the vertical and horizontal members together form a structure having an upside down T-shaped cross-section viewed in a length direction of the structure, the vertical member being structured and arranged to be disposed with an inner surface of the vertical member against an outer surface of a building frame erected atop the building foundation; and a sheathing locator projecting from an outer surface of the vertical member at a location vertically spaced above the horizontal member, the sheathing locator being structured and arranged to be abutted by a lower edge of a sheathing panel so as to locate the lower edge of the sheathing panel vertically higher than the building foundation.

4. The foundation flashing of claim 3, further comprising an insect shield joined to an innermost edge of the inner portion of the horizontal member, the insect shield sloping downwardly in a direction away from the vertical member.

5. A foundation flashing for use in construction of a building of the type including a foundation having an upper surface, a frame built upon said upper surface of said foundation, and vertically oriented exterior sheathing attached to outer surfaces of said frame, the foundation flashing comprising:

a horizontal member adapted to rest atop said upper surface of said foundation between said upper surface and said frame;

a vertical member joined to the horizontal member, at least a portion of the vertical member being adapted to lie against an outer surface of said sheathing with an inner surface of said portion opposing said sheathing;

at least one sheathing locator projecting generally horizontally from the inner surface of said portion of the vertical member, the sheathing locator being positioned to be abutted by a bottom edge of said sheathing when said sheathing is affixed to said frame, whereby the sheathing locator provides a reference for locating said sheathing relative to said foundation; and a nail stop guide formed on an outer surface of said portion of the vertical member, the nail stop guide being spaced vertically higher than the sheathing locator and providing a readily visible indication warning a worker not to nail through the vertical member below the nail stop guide.

6. The foundation flashing of claim 5, wherein the nail stop guide comprises a line printed onto the outer surface of the vertical member.

7. The foundation flashing of claim 5, wherein the nail stop guide comprises a protrusion formed on the outer surface of the vertical member.

8. The foundation flashing of claim 5, wherein the horizontal member includes an outer portion adapted to extend outwardly beyond an outer surface of said foundation wall, said outer portion being adapted to be anchored within brick veneer applied over said sheathing.

9. The foundation flashing of claim 5, adapted to be installed atop a vertical foundation wall having an inner surface, wherein the horizontal member includes an inner portion adapted to extend inwardly beyond said inner surface of said foundation wall, said inner portion defining an integral shield for crawling insects tending to deter such insects from crawling from said inner surface of said foundation wall to said frame.

10. The foundation flashing of claim 9, wherein the integral shield slopes downwardly away from said foundation wall.

* * * * *

UNITED STATES PATENT AND TRADEMARK OFFICE

CERTIFICATE OF CORRECTION

PATENT NO. : 6,427,390 B1
DATED : August 6, 2002
INVENTOR(S) : Thies

It is certified that error appears in the above-identified patent and that said Letters Patent is hereby corrected as shown below:

Title page,
Item [*] Notice, "Subject to any disclaimer, the term of this patent is extended or adjusted under 35 USC 154(b) by (2) days", delete the phrase "by 2 days" and insert -- by 0 days --

Signed and Sealed this

Fourteenth Day of October, 2003

JAMES E. ROGAN
*Director of the United States Patent and Trademark Office*